United States Patent [19]

Schwartz

[11] Patent Number: 4,744,066

[45] Date of Patent: May 10, 1988

[54] QUARTZ ANALOG MOVEMENT WITH LAVET STEPPING MOTOR AND LARGE ENERGY CELL

[75] Inventor: Herbert Schwartz, Wurmberg, Fed. Rep. of Germany

[73] Assignee: Timex Corporation, Waterbury, Conn.

[21] Appl. No.: 69,782

[22] Filed: Jul. 6, 1987

[51] Int. Cl.[4] ..... G04B 19/00; G04B 19/02

[52] U.S. Cl. ..... 368/76; 368/220

[58] Field of Search ..... 368/76, 80, 88, 157, 368/160, 220, 322–324

[56] References Cited

U.S. PATENT DOCUMENTS

| | | | |
|---|---|---|---|
| 4,426,158 | 1/1984 | Muller et al. | 368/160 |
| 4,647,218 | 3/1987 | Wuthrich | 568/160 |
| 4,679,944 | 7/1987 | Sedlak et al. | 368/157 |

*Primary Examiner*—Vit W. Miska

*Attorney, Agent, or Firm*—William C. Crutcher

[57] ABSTRACT

A movement for a three hand quartz analog timepiece has an energy cell supplying power to a timekeeping circuit which periodically steps the rotor of a Lavet type stepping motor. The stepping motor rotor drives a "seconds" wheel assembly attached to the "seconds" hand spindle through one or more intermediate wheel assemblies of gear, pinion, and spindle. A first intermediate wheel spindle of non-magnetic material is journaled such that its axis extends through the circumferential gap carrying magnetic flux between the rotor and the stator of the stepping motor. Several alternative means of journaling the first intermediate wheel assembly within the active flux gap of the stepping motor are shown and described, as well as movements having two intermediate wheel assemblies. The arrangement allows a small diameter "seconds" wheel and a relatively large energy cell, which provides a long running time for the movement.

15 Claims, 7 Drawing Sheets

QUARTZ ANALOG MOVEMENT WITH LAVET STEPPING MOTOR AND LARGE ENERGY CELL

BACKGROUND OF THE INVENTION

This invention relates generally to a quartz analog movement for a timepiece of the type utilizing a Lavet stepping motor, and more particularly it relates to a movement for a three-hand quartz analog wristwatch with a Lavet stepping motor and an improved arrangement in the speed reducing gear train driving the hands which, in turn, permits the use of a larger size energy cell in the movement.

A Lavet type stepping motor periodically steps a small permanent magnet rotor with a driving pinion through 180° and a speed reducing gear train of gears and pinions is arranged in the movement frame to drive the hands of the timepiece, which are generally mounted upon sleeves or spindles rotatably mounted in the center of the watch dial. It is desirable to use as large an energy cell as can be fitted into the movement in the space not occupied by these gear members, so that the energy cell lasts as long as possible before it is necessary to replace it. Since the capacity of the energy cell is generally related to its volume of active material, its size can be increased either by increasing its thickness or its diameter, which interfere with the very limited space in a wristwatch movement for the gear train members, the stepping motor, the integrated circuit, and other components necessary to functioning of the quart analog movement.

One proposal for accommodating the necessary speed reduction between the stepping motor rotor and the central hand spindle has been to drive a minute wheel directly at its periphery using a relatively large wheel which overlaps a relatively thin but large diameter energy cell. This arrangement is shown and described in assignee's U.S. Pat. No. 4,647,218 issued Mar. 3, 1987 in the name of Paul Wuthrich.

Another known arrangement for reducing the speed of the stepping motor rotor to drive a "seconds" wheel attached to a "seconds" hand spindle is through the use of an intermediate wheel assembly with a gear and pinion disposed between the rotor of the stepping motor and the central assembly of spindles and sleeves driving the hands of the timepiece. Several such arrangements are disclosed in published U.K. patent application No. GB 2 121 991 A filed Apr. 8, 1983.

A problem arises in the design of the gearing, since if the largest possible energy cell is employed, its outer diameter lies very close to the movement's center. The design of the gearing, especially of the seconds wheel and the intermediate wheel arrangement must be adapted to the remaining space. One known solution as in the aforesaid U.S. Pat. No. 4,647,218 is to use a thin energy cell and to have the battery overlapping a large diameter second wheel. This provides sufficient battery life if the stepping motor is indexed only once per minute, but if the stepping motor is indexed once per second in a three hand watch, a thicker energy cell would provide more capacity.

Another proposal is to use a small diameter energy cell in order to allow the diameter of the second wheel to be placed adjacent and in line with the energy cell. This is undesirable, since by increasing the diameter of the energy cell, more capacity could be achieved.

A third known proposal is to employ a small diameter "seconds" wheel beside an energy cell which is large in both thickness and diameter. However, in this known proposal, the intermediate wheel assembly performing the gear reduction overlaps the axis of the "seconds" wheel so that a special intermediate bridge has to be employed in order to journal or rotatably support the seconds wheel.

A fourth known proposal, as described in U.S. Pat. No. 4,518,884 issued May 21, 1985, is to place a gear train arbor of ferro-magnetic material, e.g. steel in a deep groove in one of the stator pole pieces. However, this requires compensation for the presence of the arbor by shifting the pole pieces, and requires location of the groove at 90° with respect to NS of the magnet poles when the rotor is in the rest position.

Accordingly, one object of the present invention is to provide an improved arrangement for the reduction gearing in a timepiece movement which permits a larger energy cell to be employed in the timepiece.

Another object of the invention is to provide an improved gear reduction assembly for a three hand quartz analog timepiece with a Lavet stepping motor which permits a larger energy cell.

Still another object of the invention is to provide an improved gear arrangement for mounting an intermediate wheel assembly between the rotor of a Lavet stepping motor and the "seconds" wheel driving the second hand at the center of the timepiece movement.

SUMMARY OF THE INVENTION

Briefly stated, the invention comprises an improvement in a movement for a quartz analog timepiece having an energy cell, a stepping motor, a timekeeping circuit connected to the energy cell and supplying driving pulses to the stepping motor, a frame, a bridge, and a "seconds" wheel assembly comprising gear, pinion, and spindle rotatably mounted in the center of the movement. The movement further includes a rotor for the stepping motor, a stator defining a circumferential gap around the rotor, and at least a first intermediate wheel assembly comprising gear, pinion, and first spindle with an axis of rotation, the gear of the first intermediate wheel assembly engaged with the pinion of the rotor, wherein the improvement comprises non-magnetic bearing means mounting a first spindle of non-magnetic material for the first intermediate wheel assembly, such that its axis extends through the circumferential active flux gap between the stepping motor rotor and stator. The pinion of the first intermediate wheel assembly may directly engage the "seconds" wheel assembly or may drive the "seconds" wheel assembly through a gear reduction comprising a second intermediate wheel assembly.

DRAWINGS

The subject matter which is regarded as the invention is particularly pointed out and distinctly claimed in the concluding portion of the specifications. The invention, however, both as to organization and method of practice together with further objects and advantages thereof, may best be understood by reference to the following description, taken in connection with the accompanying drawing, in which:

FIG. 1 is a plan view of the back of a quartz analog wristwatch movement having portions of the bridge cut away to show a preferred embodiment of the invention, FIG. 2 is an elevation drawing partly in cross-section taken along the lines II—II of FIG. 1, FIG. 3 is partial elevation drawing partly in cross-section taken along lines III—III of FIG. 1, FIG. 4 is a partial elevation drawing, partly in cross-section, showing a prior art arrangement of stepping motor, intermediate wheel assembly, "seconds" wheel assembly, and battery.

FIG. 5 is a similar partial elevation drawing, partly in cross-section showing another prior art arrangement.

FIGS. 6, 7, and 8 are cross-sectional partial elevation drawings showing three modifications of the mounting of the intermediate wheel assembly, which is shown in FIG. 2, FIG. 9 is a plan view of a portion of the movement illustrating a modification of the movement illustrated in FIG. 1, FIG. 10 is a plan view illustrating another modification of the FIG. 1 movement, FIG. 11 is a plan view of a movement with two intermediate wheel assemblies, and FIG. 12 is an elevation drawing, partly in cross-section, taken along lines XII—XII of FIG. 11.

DESCRIPTION OF THE PREFERRED EMBODIMENT

Figure 1:
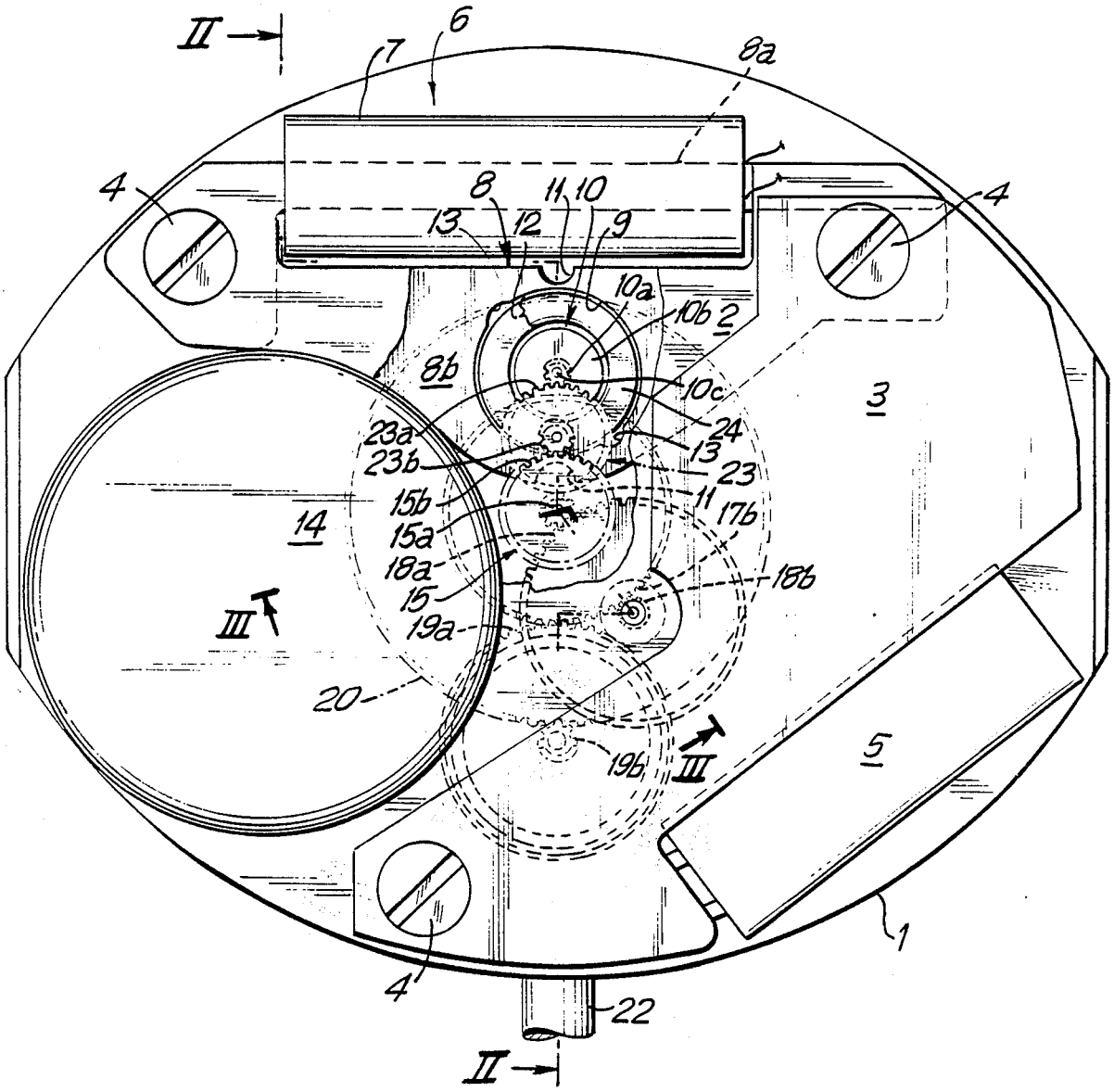

Referring now to FIG. 1 of the drawing a watch movement comprises a plastic frame member, the outline of which is shown at reference numeral 1, serves as the main structural member of the movement of a three-hand quartz analog wristwatch. Frame 1 is partially covered on the back side of the movement facing the viewer by a plastic bridge member 2. Frame 1 and bridge 2 serve to rotatably journal between them members of the gear reduction train. Since bridge 2 would normally obscure the gear members, it has been cut away in the drawing in order to reveal the more essential features of the invention.

Figure 2:
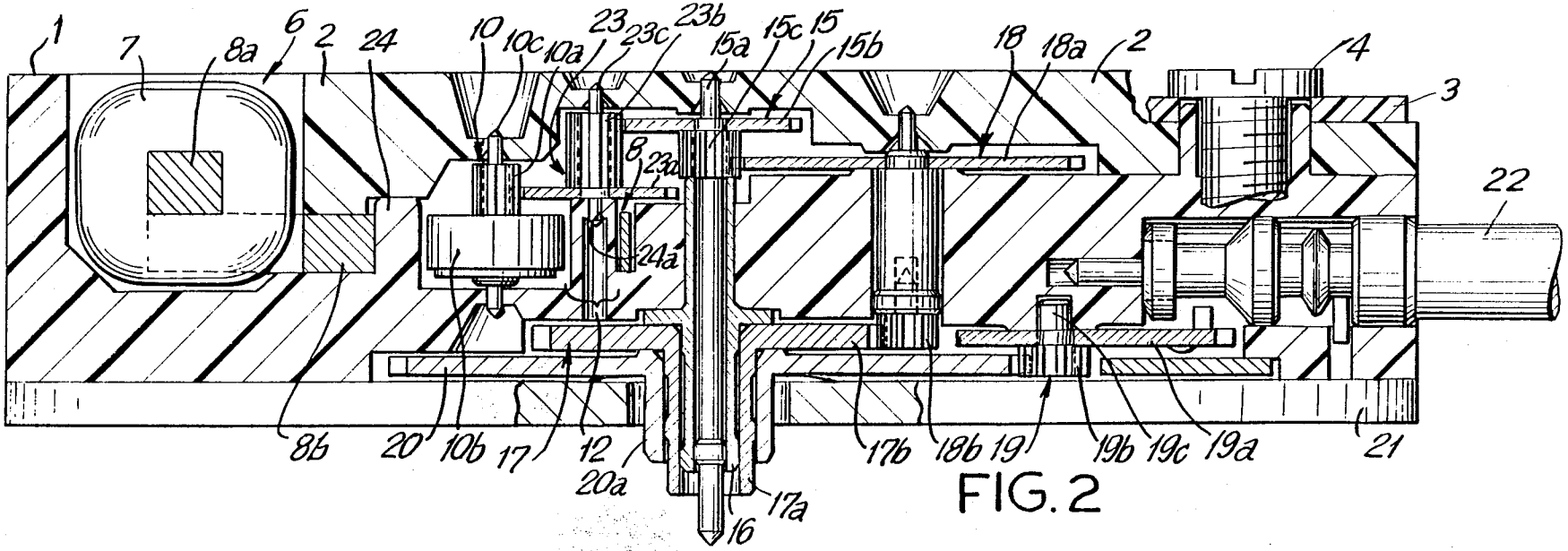
Figure 3:
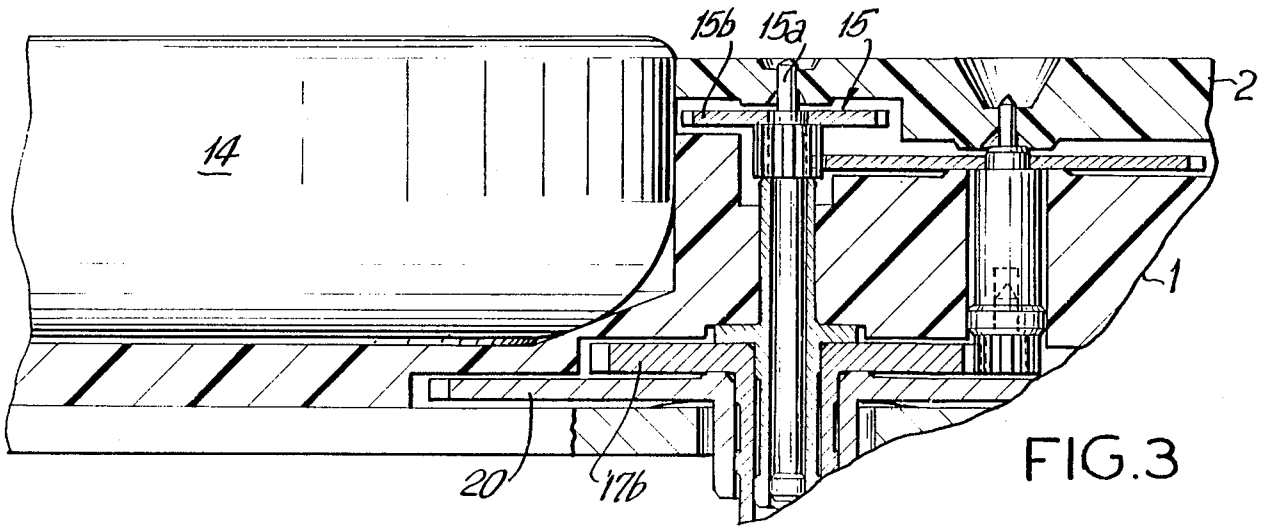

FIGS. 2 and 3, which are cross-sectional elevation drawings taken along lines II—II and III—III respectively of FIG. 1, may be referred to along with the description of FIG. 1 to identify the major components.

A printed circuit board 3 is mounted on top of bridge 2 by means of screws 4. A quartz crystal 5 is connected to terminals (not shown) beneath the printed circuit board. The printed circuit board carries an integrated circuit (not shown) which provides periodic driving pulses, preferably once per second, to a stepping motor shown generally at 6. The stepping motor is of the Lavet type and includes a coil 7 connected to receive the periodic energizing pulses from the integrated circuit.

A stator member, a portion of which can be seen at 8, is constructed in two overlapping sections, one part including a core member 8*a* passing through the center of coil 7 and the other part including a one piece external stator member 8*b*. Stator external member 8*b* and coil core 8*a* are magnetically permeable members which are secured together with screws 4 to provide a closed path for magnetic flux. External stator member 8*b* defines a central opening 9 surrounding a rotor assembly shown generally as 10. Rotor 10 (see also FIG. 2) comprises a gear pinion 10*a*, and a bipolar permanent magnet 10*b* both coaxially disposed on a spindle 10*c*. The external stator member 8*b* is designed in a manner well-known in the art, to include opposed notches 11 near opening 9. These cause saturation during an energizing pulse and cause magnetic flux to bridge a circumferential gap 12, sometimes known as an "air gap," defined between the inside edge of opening 9 and the outer dimensions of permanent magnet 10, so as to step the rotor 180°. Although magnet 10*b* is indicated as circular, it is not necessarily so and may be rectangular. However, when it rotates, it sweeps through a circle, and hence the term circumferential gap which is used herein. Also the opening 9 may not be strictly circular, but may have offset portions, or may be interrupted by radial gaps in the case of a two piece stator. Such variations are not intended to restrict the term circumferential gap used herein. In the absence of a pulse, the rotor is caused to assume a "rest position" by means of diametrically opposed shallow notches 13 which face into the circumferential gap 12.

The aforedescribed operation of a Lavet type motor is well-known and has been specifically illustrated in FIG. 1 with respect to a one-piece stator external plate 8*b*. However, other types of Lavet motors include two-piece stators with two pole shoes separated by a pair of radial bridging gaps in lieu of the narrow strips provided by notches 11. The two pole shoes may be slightly offset from one another to determine a rotor rest position in lieu of using notches 13 to perform this function.

The remaining space inside the movement is used as carefully as possible to accommodate a button-type energy cell 14. Energy cell 14 is made as large in diameter as possible in accordance with the object of the present invention following the contour of stator plate 8*b*, and coming as close as possible to the central axis of the watch, being limited only by the outer diameter of a "seconds" wheel assembly shown generally as 15. Energy cell 14 is also made as thick as possible within the confines of the movement.

Referring again to FIG. 2 of the drawing, the "seconds" wheel assembly 15 includes a spindle 15*a*, a "seconds" wheel 15*b*, and a pinion 15*c*. One journal of the spindle 15*a* is rotatably mounted in a bore in bridge 2, while the other journal is supported in a center post 16 fixed in the frame 1. Spindle 15*a* projects beyond post 16 to carry a timepiece "seconds" hand (not shown). Rotatably mounted on the outside of center post 16 is a center wheel assembly 17, having a sleeve 17*a* for carrying the minutes hand (not shown), and having a center wheel gear 17*b*. The latter can also be seen in outline form in FIG. 1. A gear reduction between the "seconds" wheel assembly 15 and the center wheel assembly 17 is made by means of a third wheel assembly 18 rotatably mounted in bores in the frame and bridge. The third wheel assembly includes a gear 18*a* meshing with pinion 15*c* and a pinion 18*b* meshing with center wheel gear 17*b*. A further gear reduction is made by means of a minute wheel assembly 19, having a gear 19*a*, which can also be seen in outline form in FIG. 1, and a pinion 19*b*. Minute wheel assembly 19 is journaled on a stub 19*c* in frame 1. The hour wheel 17*b* engages gear 19*a* (shown only in outline form in FIG. 1) and pinion 19*b* of the minute wheel assembly engages a hour wheel 20. Hour wheel 20 is rotatably mounted on a sleeve 20*a* which carries the hour hand.

Referring to FIG. 3 of the drawing, a partial elevation view is shown of the seconds wheel assembly 15 and its position in relation to energy cell 14. As can be seen, "seconds" wheel 15*b* is relatively small in diameter and comes very close to the outer periphery of energy cell 14. Energy cell 14 is also made as thick as possible, but overlaps the center wheel gear 17*b* and the hour wheel 20. It remains to note that the movement includes a dial 21 and a set stem 22. Stem 22 may be pulled out to engage gearing to turn the minute wheel gear 19*a* in a conventional manner.

The foregoing description relates to conventional aspects of the movement. The present invention concerns an improvement in journaling the first intermediate wheel assembly which provides a speed reduction between stepping motor rotor 10 and the "seconds" wheel assembly 15. This first intermediate wheel assembly, indicated by reference number 23 in FIG. 2 comprises a gear 23*a*, and a pinion 23*b* mounted on a spindle 23*c* of non-magnetic material such as beryllium copper, stainless steel, or plastic. Gear 23*a* meshes with rotor pinion 10*a*, while pinion 23*b* meshes with "seconds" wheel 15*b*. One end of intermediate wheel spindle 23*c* is rotatably mounted in a bore in bridge 2. The other end is rotatably mounted in non-magnetic bearing means located in a cylindrical wall 24 which is part of frame 1 and which extends through the circumferential active flux gap 12 defined between the stepping motor stator and the stepping motor rotor. Since the frame material is plastic, cylindrical wall 24 having a magnetic permeability almost equal to that of air, does not appreciably affect the flux passage through the circumferential gap. A bore 24*a* in cylindrical wall 24 serves as the bearing means to rotatably mount the other end of spindle 23*c*, such that its axis will pass through or extend through the circumferential flux gap between rotor and stator. Spindle 23*c* being of non-magnetic material also will not disturb the functioning of the motor. This enables a very short spacing to be achieved between respective axes of the rotor, the first intermediate wheel assembly and the "seconds" wheel assembly. This short spacing permits a small diameter "seconds" wheel gear 15*b*. FIG. 1 of the drawing illustrates the relative distances between the axes of gear reduction, including the relative location and spacing between stepping motor rotor, first intermediate wheel assembly, and "seconds" wheel assembly, and their positions in relation to the energy cell 14.

Figure 4:
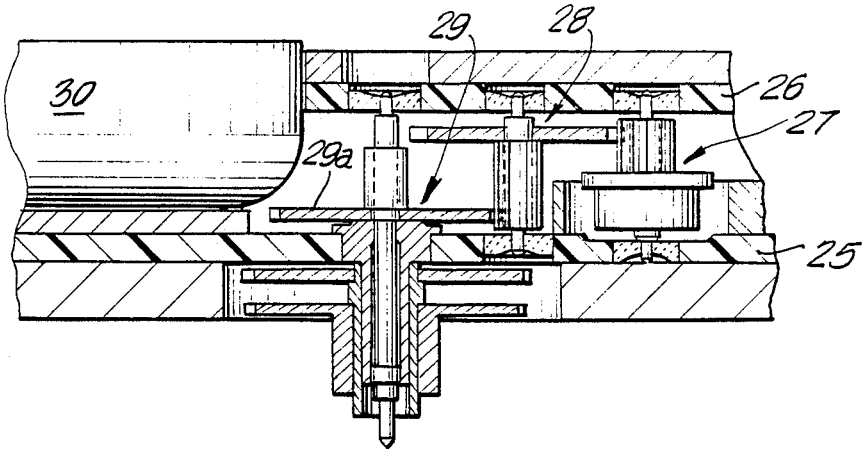
(PRIOR ART) FIG.4
Figure 5:
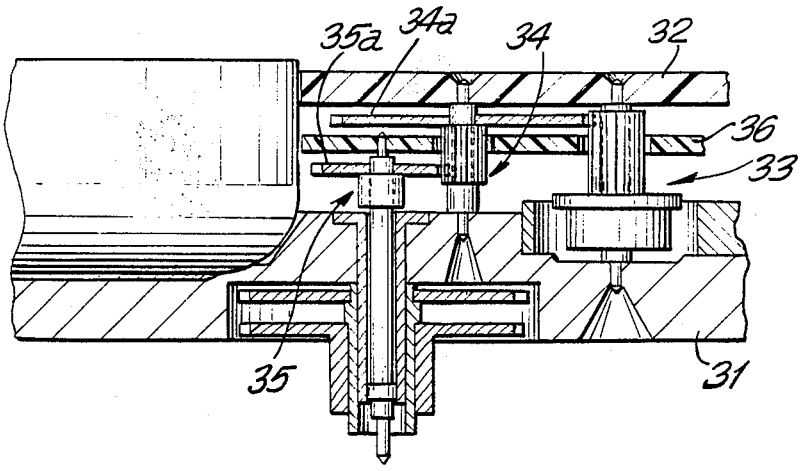
(PRIOR ART) FIG.5

The advantages of the present invention are best appreciated by reviewing two prior art arrangements shown in FIGS. 4 and 5 of the drawings. Only the elements deemed material to the present invention will be discussed. In FIG. 4, a frame 25 and a bridge 26 rotatably mount between them a stepping motor rotor 27, an intermediate wheel assembly 28, and a "seconds" wheel assembly 29. The gear 29*a* of the "seconds" wheel assembly is relatively large in diameter, necessitating the use of a thin energy cell 30, which partially overlaps the "seconds" wheel.

FIG. 5 shows a frame 31, and a bridge 32 mounting between them a stepping motor rotor 33, an intermediate wheel assembly 34, and a "seconds" wheel assembly 35. The gear 35*a* of the "seconds" wheel assembly is made small in diameter permitting a battery which is both thick and large in diameter. However this requires a large wheel 34*a* on the intermediate wheel assembly which overlaps the spindle axis of the "seconds" wheel assembly. This in turn requires using an intermediate bridge 36 to support the upper end of the "seconds" wheel spindle. Bridge 36 adds to cost of the movement and complicates the assembly. By use in the present invention of a first intermediate wheel assembly rotatably mounted in bearing means to cause the axis of the intermediate spindle to extend through the circumferential air gap of the stepping motor, a larger energy cell may be employed.

Figure 6:
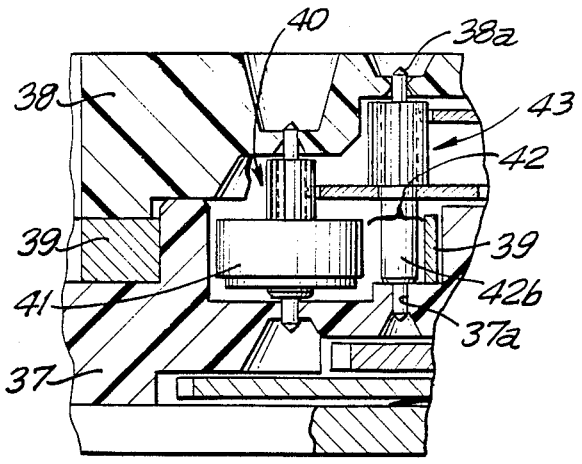
Figure 7:
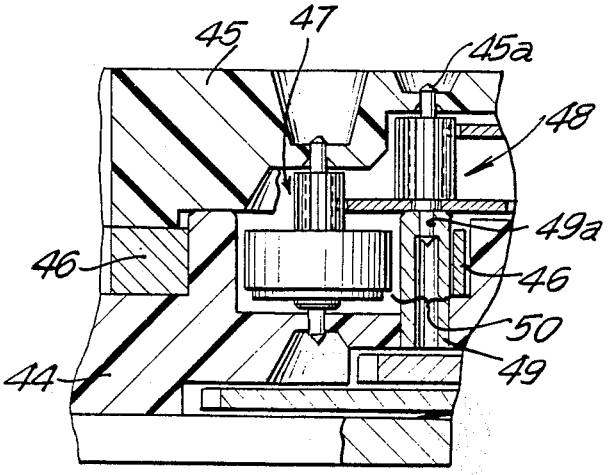
Figure 8:
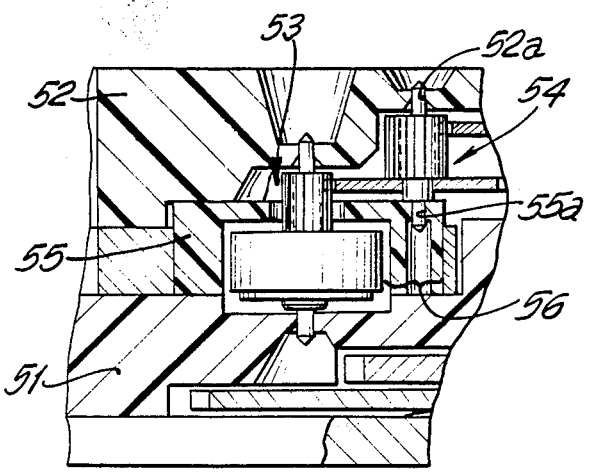

FIGS. 6, 7, and 8 illustrate modifications of the bearing means mounting the first intermediate wheel assembly such that its axis passes through the circumferential air gap of the stepping motor.

In FIG. 6, a movement frame is shown at 37 and a bridge at 38. Portions of the external stator member of the stepping motor are seen at 39. A stepping motor rotor 40 is journaled in bores of frame and bridge and includes the usual permanent magnet 41. An active flux-carrying circumferential gap 42 is defined between the stator 39 and rotor magnet 41. A first intermediate wheel assembly 43 is rotatably mounted in bores 37*a* and 38*a* in the frame 37 and bridge 38. These bores serve as non-magnetic bearing means, and the added space between bores is bridged by an extension of non-magnetic material 42*b* on the first intermediate wheel assembly which extends through the gap 42. For this application, both the extension and spindle are of non-magnetic material.

Referring to FIG. 7 of the drawing, frame and bridge are indicated by reference numericals 44, 45, respectively. Stepping motor stator is indicated at 46 and a rotor assembly at 47. A first intermediate wheel assembly is indicated at 48. The upper journal of assembly 48 is mounted in a bore 45*a*. In order to mount the lower journal of the intermediate wheel assembly 48, a bearing tube 49 of non-magnetic material is affixed at one end in frame 44 and extends through the active flux gap which is shown as reference numeral 50. It includes a bore 49*a* which serves as bearing means for assembly 48.

Yet another modification is indicated in FIG. 8, where frame and bridge are shown by reference numerals 51, 52 having a rotor assembly 53 journaled between them. A first intermediate wheel assembly 54 is rotatably mounted at its upper end in a bore 52*a* and at its lower end in a special plastic bridging cap member 55, by means of a bore 55*a*. The bridging member passes through the flux gap 56 without substantially affecting flux passage.

Figure 9:
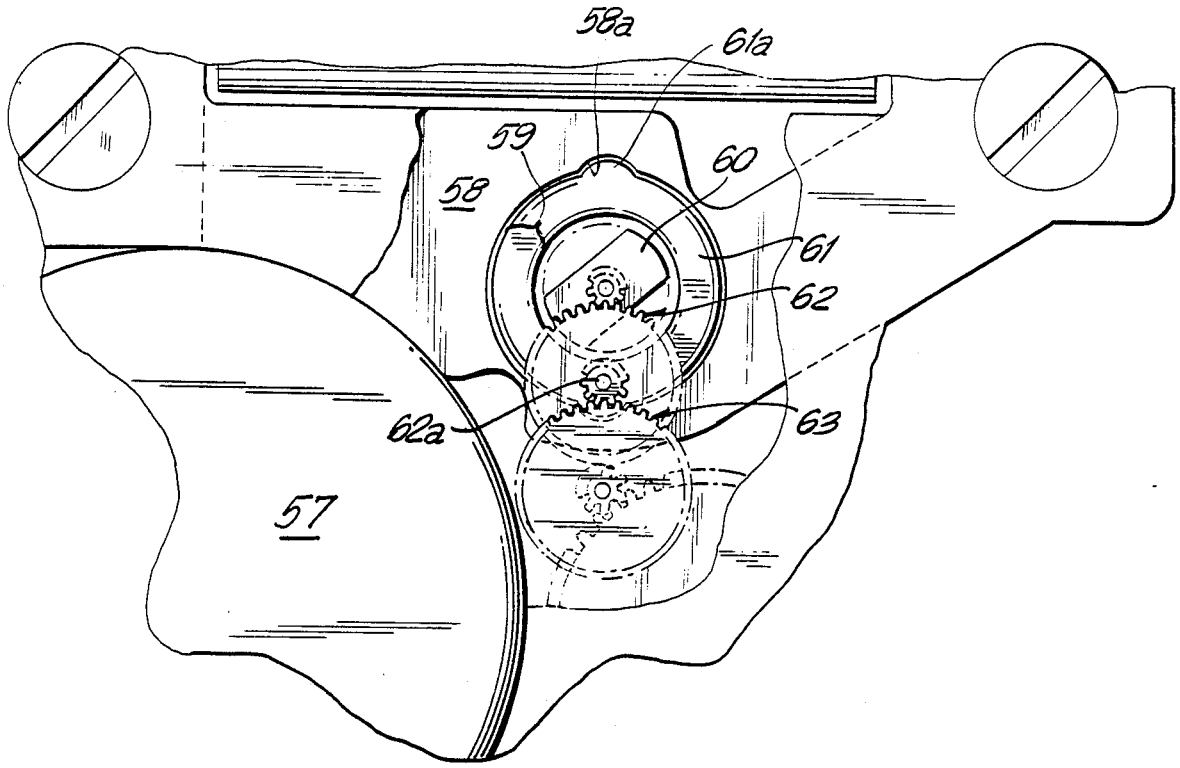

Yet another modification of the invention is shown in FIG. 9, which in plan view is similar to FIG. 1. The movement accommodates a large energy cell 57. Here the stepping motor stator indicated at 58 conforms to the energy cell outline and defines a circumferential gap 59 with a substantially rectangular permanent magnet 60 of the stepping motor. A circumferential wall 61 which may be integral with the plastic frame as before extends upward through this gap and also incorporates ears 61*a* which fit into corresponding shallow rest position notches 58*a* of the stator. A first intermediate wheel assembly 62 drives a "seconds" wheel assembly 63 as before. The additional wall thickness provided by ears 61*a* serve to provide a larger and more stable mounting for the non-magnetic spindle 62*a* of the bearing means supporting the first intermediate wheel assembly. The spindle 62*a* is disposed in the active flux gap, rather than in a deep groove which is not part of the active flux gap.

Figure 10:
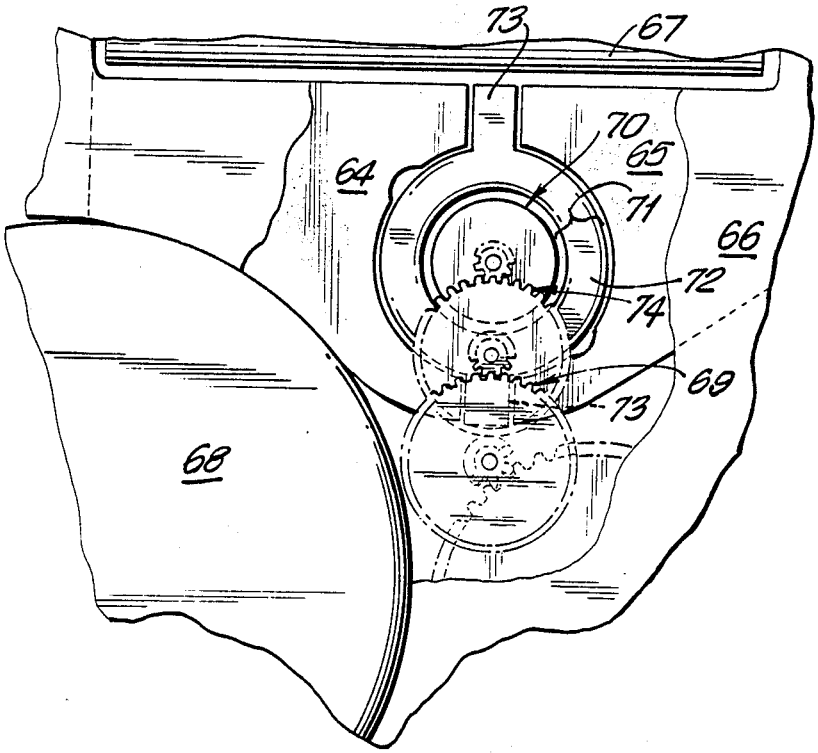

Although the invention has been illustrated in connection with a one-piece stator member, the invention is not so limited. FIG. 10 illustrates another modification used with a two-piece stator of the type known in the art. Rather than the external stator plate being manufactured in one piece as it is in FIG. 1, two opposed stator plate members 64, 65 are shown beneath the bridge 66 which is cut away to illustrate the details. Stator members 64, 65 have extensions (not shown) connecting them to a core within a stator coil 67. An energy cell 68 comes in close proximity to the gear of "seconds" wheel assembly 69. A permanent magnet 70 of a rotor assembly is positioned within a peripheral flux gap 71. A cylindrical wall 72 which is an extension of the non-magnetic frame extends upward through gap 71. This wall 72 has ears 73 which serve to separate and precisely space the ends of the two pole shoes provided by stator pieces 64, 65. A first intermediate wheel assembly 74 provides a reduction between rotor 70 and "seconds" wheel assembly 69 as before. The intermediate wheel assembly is journaled at its upper end in the bridge and has a non-magnetic spindle journaled at its lower end in the circumferential frame wall 72 in the same manner as shown in FIG. 2.

Figure 11:
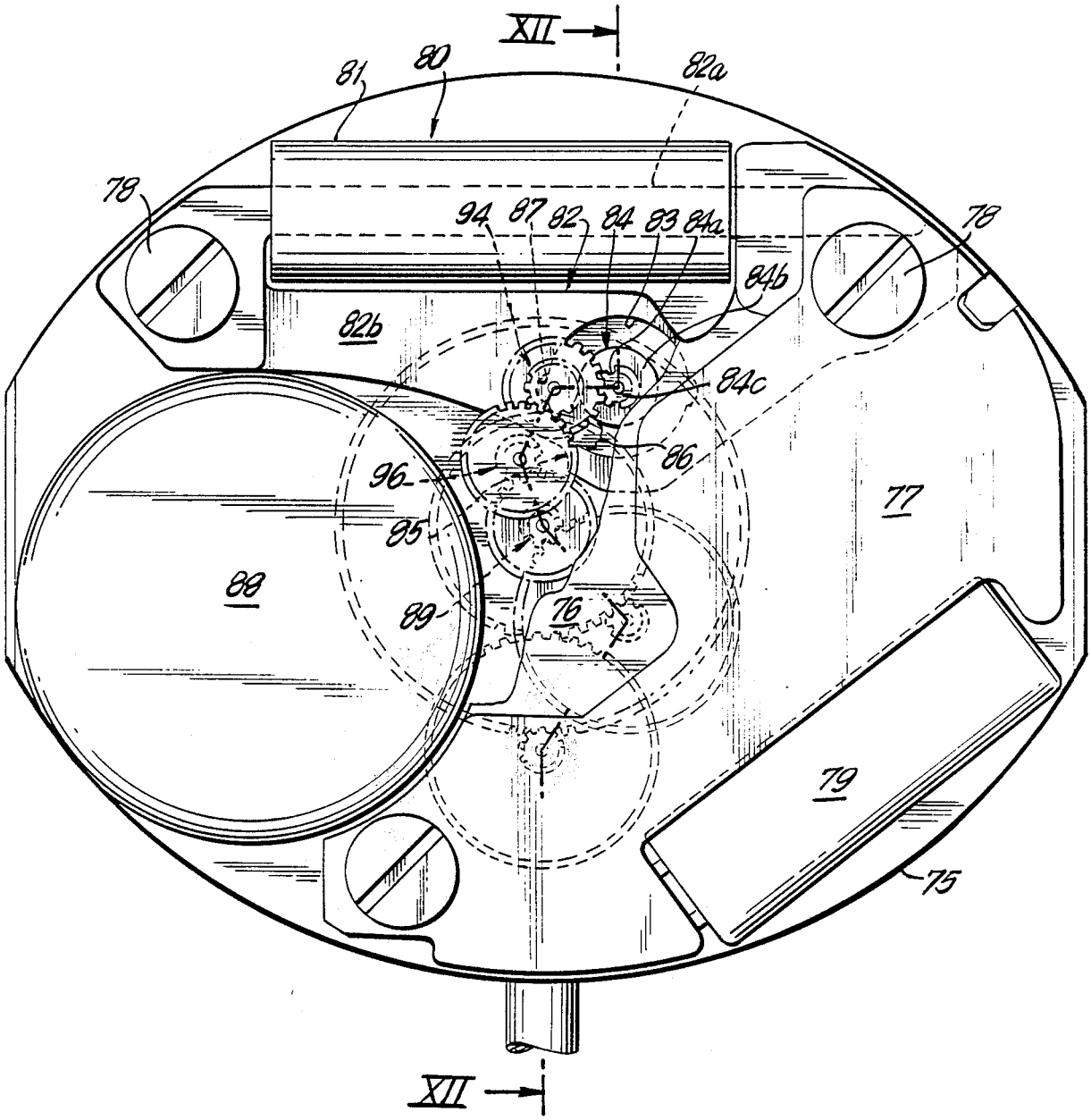
Figure 12:
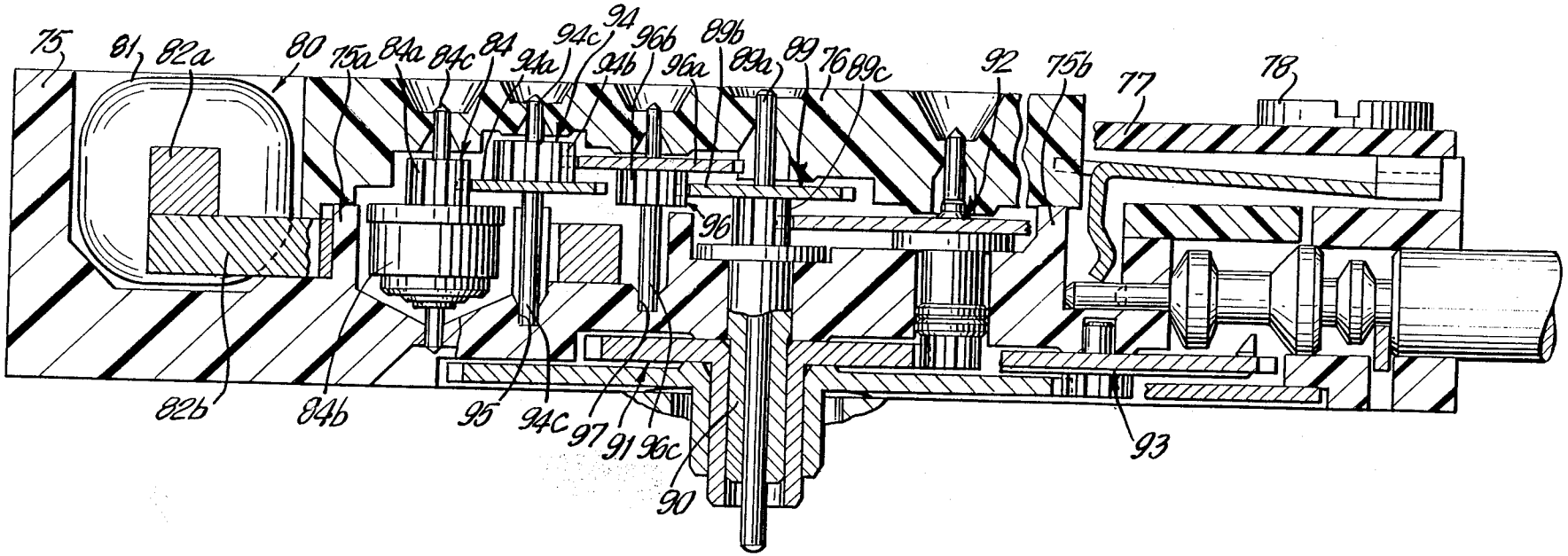

The embodiment of the invention shown in FIGS. 1–3 and in FIGS. 9 and 10 employ only one intermediate wheel assembly between the stepping motor rotor and the "seconds" wheel assembly. However, the invention is equally advantageous if two intermediate wheel assemblies are used in the speed reduction gear train between the stepping motor rotor and the "seconds" wheel assembly, since this will increase the modulus of the gearing between the rotor pinion and the seconds wheel, which serves to reduce the degree of precision needed in manufacturing the gears which, in turn, reduces the manufacturing costs. FIGS. 11 and 12 are a plan view and a developed elevation view in cross-section respectively of a wristwatch movement utilizing the invention and having two intermediate wheel assemblies. The intermediate wheel assembly which cooperates with the rotor is designated the first intermediate wheel assembly, which is arranged such that its non-magnetic spindle axis extends through the active circumferential air gap of the stepping motor in accordance with the teaching of the present invention.

Referring to FIG. 11 of the drawing, which is a plan view of the watch movement, many elements are similar to the plan view of FIG. 1 and an abbreviated description should suffice. A plastic frame member 75 is partially covered by a plastic bridge member 76, these two members being spaced apart by extensions such as **75*a* and 75*b* to journal the gear members between them. A portion of bridge 76 is removed to show the gear train. A printed circuit board 77 is attached by screws 78 and has a cutout to accommodate quartz crystal 79. A stepping motor 80 has a coil 81 and stator 82 with a core member 82*a* and one piece external stator member 82*b*. Stator member 82*b* has a central opening 83 surrounding a rotor assembly shown generally as 84. Rotor 84 (see also FIG. 12) has a gear pinion 84*a*, a permanent magnet 84*b* on a spindle 84*c*. Stator 82*b* is designed with narrow diametrically opposed saturation regions provided by recesses 85 close to the opening 83 and also includes diametrically opposed shallow notches 87 facing the air gap 86 to cause the rotor to assume a rest position between steps. A button-type energy cell 88** is selected which may be of added diameter and thickness in keeping with the objects of the present invention to achieve long battery life.

FIG. 12 of the drawing illustrates a "seconds" wheel assembly 89 with a spindle **89*a*, a "seconds" wheel 89*b*, and a pinion 89*c*. The "seconds" wheel assembly 89 is rotatably journaled on a center post 90, which cooperates with a center wheel assembly 91, third wheel assembly 92 and minute wheel assembly 93, these being rotatably journaled and performing the same functions as previously described in connection with FIG. 12**.

The primary difference between the arrangement of FIGS. 11 and 12 and the arrangement of FIGS. 1–3 lies in the use of two intermediate wheel assemblies between stepping motor rotor 84 and "seconds" wheel assembly 89. Specifically, a first intermediate wheel assembly indicated by reference numeral 94 includes a gear **94*a* meshing with rotor pinion 84*a*, and a pinion 94*b*, these being rotatably mounted on a non-magnetic beryllium copper spindle 94*c*. The lower end of spindle 94*c* is rotatably journaled in pocket bearing hole 95 in frame 75. The first intermediate gear assembly 94** is arranged such that its axis extends through the circumferential gap in accordance with the present invention.

A second intermediate wheel assembly, shown by reference 96 includes gear **96*a*, pinion 96*b* and spindle 96*c*. Spindle 96*c* is similarly journaled in a pocket 97**.

The first and second intermediate wheel assemblies perform a speed reduction between the stepping motor rotor and the "second" wheel assembly. The first intermediate wheel assembly 94 is journaled such that its axis extends through the air gap, while the axis of the second intermediate wheel assembly 96 lies outside of the stator of the stepping motor.

In all of the foregoing arrangements a non-magnetic spindle of the first intermediate wheel assembly is rotatably mounted by non-magnetic bearing means arranged such that the spindle axis of rotation extends through the circumferential active flux gap defined between the stator and rotor of the stepping motor. This permits a very compact assembly of speed reduction members between the stepping motor rotor and the "seconds" wheel assembly. Since the "seconds" wheel assembly lies at the center of the movement this permits a small diameter "seconds" wheel. The spindle axis may be located any place in the air gap. This in turn permits a large diameter and thick energy cell to be employed which increases the running time of the timepiece between battery changes.

While there has been described what is considered to be the preferred embodiment of the invention and several modifications thereof, it is desired to secure in the appended claims all such modifications as fall within the true spirit and scope of the invention.

I claim:

1. In a movement for a timepiece having an energy cell, a stepping motor, a timekeeping circuit connected to said energy cell and supplying driving pulses to said stepping motor, a frame, and a bridge spaced from said frame for rotatably supporting gear wheel assemblies therebetween, the improvement comprising:

a rotor for said stepping motor comprising permanent magnet, pinion and spindle, said stepping motor spindle being rotatably mounted on said frame, a stator for said stepping motor comprising magnetically permeable plate means aligned with said rotor permanent magnet and defining a circumferential gap with said rotor for passage of magnetic flux between said stator and said rotor, a first intermediate wheel assmbly comprising gear, pinion and first spindle having an axis of rotation, at least said first spindle being comprised of non-magnetic material, said gear of said first intermediate wheel assembly engaged with the pinion of said rotor, and non-magnetic bearing means rotatably mounting said first spindle such that its axis extends through said circumferential gap.

2. The improvement according to claim 1, wherein said non-magnetic bearing means comprises a wall extension of said frame extending into said circumferential gap and having a first bore therein rotatably mounting one end of said first spindle.

3. The improvement according to claim 1, wherein said non-magnetic bearing means comprises a second bore in said frame facing said circumferential gap and wherein a non-magnetic extension on said first spindle extends through said circumferential gap into said second bore.

4. The improvement according to claim 1, wherein said non-magnetic bearing means comprises a non-magnetic tube fixed in said frame and extending through said circumferential gap and having a third bore therein receiving one end of said first spindle.

5. The improvement according to claim 1, wherein said non-magnetic bearing means comprises a plastic bridging member surrounding portions of said rotor and fixed in said frame, said plastic member having a wall extending through said circumferential gap and defining a fourth bore in said wall receiving one end of said first spindle.

6. The improvement according to claim 1, wherein said non-magnetic bearing means comprises a wall extension of said frame extending into said circumferential gap, and having a fifth bore extending through the length of said wall extension and terminating in said frame, said fifth bore journaling one end of said first spindle.

7. The improvement according to claim 1, and further including a "seconds" wheel assembly comprising gear, pinion, and spindle rotatably mounted between said frame and said bridge, the gear of said seconds wheel assembly being of small diameter and disposed close to the energy cell, the pinion of said first intermediate wheel assembly being connected to drive said seconds wheel assembly.

8. The improvement according to claim 7, wherein said pinion of the first intermediate gear assembly directly engages the gear of said 37 seconds" wheel assembly.

9. The improvement according to claim 7, and further including a second intermediate gear assembly comprising gear, pinion and spindle rotatably mounted between said frame and said bridge, the pinion of said first intermediate gear assembly engaging the wheel of said second intermediate gear assembly, and the pinion of said second intermediate gear assembly engaging the gear of said "seconds" wheel assembly.

10. The improvement according to claim 1, wherein said stator plate means comprises an integral one piece plate member defining a hole surrounding said rotor and defining the outside of said circumferential gap.

11. The improvement according to claim 1, wherein said stator plate means comprises a pair of opposed pole shoe members defining an opening therebetween, and spaced from said rotor to define said circumferential gap.

12. The improvement according to claim 1, wherein said stator plate means defines at least one shallow notch facing said circumferential gap and wherein said non-magnetic bearing means is arranged in the location of said notch such that said first intermediate wheel assembly axis passes through said circumferential gap between said notch and the rotor magnet.

13. The improvement according to claim 7 including a third wheel assembly meshing with the pinion of said seconds wheel assembly, and a center wheel driven by said third wheel assembly, said center wheel being coaxially mounted around said "seconds" wheel assembly spindle.

14. The improvement according to claim 1, wherein said first spindle is comprised of beryllium copper.

15. In a movement for a quartz analog wristwatch having an energy cell, a Lavet stepping motor having a rotor with permanent magnet, pinion, and spindle and having a stator defining an opening surrounding said rotor and spaced therefrom to define a circumferential gap for the passage of magnetic flux, a frame supporting said stepping motor, a "seconds" wheel assembly comprising gear, pinion, and spindle rotatably mounted in the center of said frame, and a first intermediate wheel assembly comprising a gear engaged with the pinion of said rotor, said first intermediate wheel assembly being arranged to drive said seconds wheel assembly so as to perform a speed reduction drive between the stepping motor rotor and the "seconds" wheel assembly, the improvement in the aforesaid known movement comprising:

a spindle for said first intermediate wheel assembly comprised of non-magnetic material, and non-magnetic bearing means rotatably mounting said spindle of said first intermediate wheel assembly such that its axis extends through said circumferential gap between rotor and stator.

* * * * *